US005743094A

United States Patent [19]

Zimron et al.

[11] Patent Number: 5,743,094

[45] Date of Patent: Apr. 28, 1998

[54] METHOD OF AND APPARATUS FOR COOLING A SEAL FOR MACHINERY

[75] Inventors: Ohad Zimron, Gan Yavne; Shimon Hatzir, Holon; Meir Regal, Doar Na Avatah; Nadav Amir, Rehovot, all of Israel

[73] Assignee: Ormat Industries Ltd., Yaune, Israel

[21] Appl. No.: 720,172

[22] Filed: Sep. 25, 1996

Related U.S. Application Data

[63] Continuation of Ser. No. 199,697, Feb. 22, 1994, abandoned.

[51] Int. Cl.[6] ..... E01D 25/08

[52] U.S. Cl. ..... 60/646; 60/656; 415/176

[58] Field of Search ..... 60/646, 656; 277/3, 277/22, 81 R, 59, 65; 415/111, 112, 175, 176

[56] References Cited

U.S. PATENT DOCUMENTS

| | | | |
|---|---|---|---|
| 3,038,318 | 6/1962 | Hanny | 62/192 |
| 3,213,798 | 10/1965 | Carswell | 415/176 |
| 4,189,156 | 2/1980 | Geary, Jr. et al. | 415/112 |
| 4,692,090 | 9/1987 | Naka | 415/112 |
| 4,997,340 | 3/1991 | Zinsmeyer et al. | 415/105 |
| 5,147,015 | 9/1992 | Snuttjer et al. | 184/6.22 |
| 5,340,272 | 8/1994 | Fehlau | 415/110 |

FOREIGN PATENT DOCUMENTS

| | | | |
|---|---|---|---|
| 574739 | 7/1924 | France . | |
| 1170806 | 1/1959 | France . | |
| 0072802 | 4/1986 | Japan | 60/657 |
| 6172802 | 4/1986 | Japan . | |
| 513849 | 10/1939 | United Kingdom . | |

OTHER PUBLICATIONS

English Language Abstract of JP 59–201542, Apr. 23, 1986.
European Search Report and Annex.

*Primary Examiner*—Ira S. Lazarus
*Assistant Examiner*—Alfred Basichas
*Attorney, Agent, or Firm*—Donald M Sandler

[57] ABSTRACT

A seal heated by hot pressurized vapor is cooled by providing a chamber in which the seal is located and for containing vapor that leaks thereinto. The pressure in the chamber is reduced by connecting it to a source of low pressure; and liquid is supplied to the chamber at a pressure above the reduced pressure of the chamber and at a temperature below the temperature of vapor leaking into the chamber. The liquid is introduced into the chamber as droplets for contacting vapor that leaks thereinto thereby cooling the vapor and thus cooling the seal. The flow rate of the liquid is adjustable in accordance with the temperature of the liquid in the chamber.

41 Claims, 3 Drawing Sheets

METHOD OF AND APPARATUS FOR COOLING A SEAL FOR MACHINERY

This application is a continuation, of application Ser. No. 08/199,697 filed Feb. 22, 1994, now abandoned.

TECHNICAL FIELD

This invention relates to a method of and apparatus for cooling a seal for machinery including rotating machinery, and more particularly, for cooling the seal of a turbine shaft.

BACKGROUND OF THE INVENTION

Rotating machinery, such as turbine wheels mounted on a shaft, require rotary seals in the region where the shaft passes through the pressure chamber that contains the turbine wheels. Such seals inhibit leakage of working fluid from the pressure chamber into the seal operating environment and then into the atmosphere. In addition, seals are also required in other machinery.

Seals for rotating machinery usually comprise a labyrinth seal followed by a mechanical seal. Labyrinth seals serve to restrict the rate of flow of working fluid and reduce its pressure toward atmospheric pressure, but not to prevent or contain the flow. Typically, labyrinth seals have many compartments positioned very close to the surface of the shaft for presenting to the working fluid in the pressure chamber a torturous path that serves to reduce pressure and inhibit, but not halt leakage. A mechanical seal, on the other hand, serves to contain the working fluid. The extent to which containment is achieved depends on the design of the seal and the nature of the working fluid involved.

When the working fluid is steam, some escape of the working fluid can be tolerated. Nevertheless, a shaft seal for the steam turbine is a critical item. It is even more critical when the working fluid is a hydrocarbon, such as pentane or isopentane, and the turbine operates as part of an organic Rankine cycle power plant. In such case, the mechanical seals must preclude to as great an extent as possible the loss of working fluid to the atmosphere.

Reliable operation of the mechanical seals for turbines, as well as for other types of equipment where the temperature of the mechanical seal is elevated, requires the seals to operate under optimum working conditions of pressure, temperature, vibration, etc. These working conditions have a significant impact on seal leakage rates and seal life expectancy, for example. By extending seal life, turbine life and hence reliability is extended.

Seal life is adversely affected by high operating pressure which tends to distort seal faces. High operating pressure also increases wear rate, heat generated at the seal faces which further distorts seal faces and results in increased leakage. In addition, the high pressure increases power consumption for the turbine sealing system.

Seal life is adversely affected by high operating temperatures of the seal components. High seal component temperatures increase wear on the seal faces, and also increase the likelihood that the barrier fluid when used will boil.

It is therefore an object of the present invention to provide a new and improved method of and apparatus for cooling the seals for equipment.

BRIEF DESCRIPTION OF THE INVENTION

A seal heated by hot pressurized vapor is cooled by providing a chamber in which the seal is located and for containing vapor that leaks thereinto. The pressure in the chamber is reduced by connecting it to a source of low pressure; and liquid is supplied to the chamber at a pressure above the reduced pressure of the chamber and at a temperature below the temperature of vapor leaking into the chamber. The liquid is introduced into the chamber as droplets for contacting vapor that leaks thereinto thereby cooling the vapor and thus cooling the seal. The flow rate of the liquid is adjustable in accordance with the temperature of the liquid in the chamber.

According to the present invention, apparatus for cooling a hot mechanical seal, gas seal or other seal heated by hot pressurized vapor and/or friction includes a chamber for locating therein the seal and for containing vapor and a connection for connecting the chamber to a source of low pressure thereby reducing the pressure in the chamber to a level below the pressure of vapor that flows into the chamber. A further connection is provided for supplying liquid to the chamber at a pressure above the reduced pressure of the chamber. Finally, apparatus is provided for distributing the liquid throughout the chamber in the form of droplets that contact and cool vapors in the chamber, thus cooling the seal.

The seal may be associated with the turbine of a Rankine cycle power utilizing an organic working fluid, or a power plant utilizing steam. Preferably, the liquid is distributed throughout the chamber in the form of droplets which contact vapor leaking into the chamber through a labyrinth or other seal thus cooling the vapor thereby indirectly cooling the seal by reducing the temperature of the environment surrounding or associated with the seal. Indirect cooling of the seal, as distinguished from applying the liquid directly to the seal, serves to prevent thermal shock to the materials of the seal.

In the preferred form of the invention, where the seal is part of a turbine that receives vaporized working fluid from a vaporizer and within which the vaporized working fluid expands producing expanded working fluid, and where the expanded working fluid is condensed in a condenser to produce condensate that is returned to a vaporizer by a cycle pump, the chamber containing the seal is connected to the condenser, and the liquid supplied to the chamber is furnished by the cycle pump.

BRIEF DESCRIPTION OF THE DRAWINGS

Embodiments of the present invention are described by way of example with reference to the accompanying drawings wherein.

DETAILED DESCRIPTION

Figure 1:
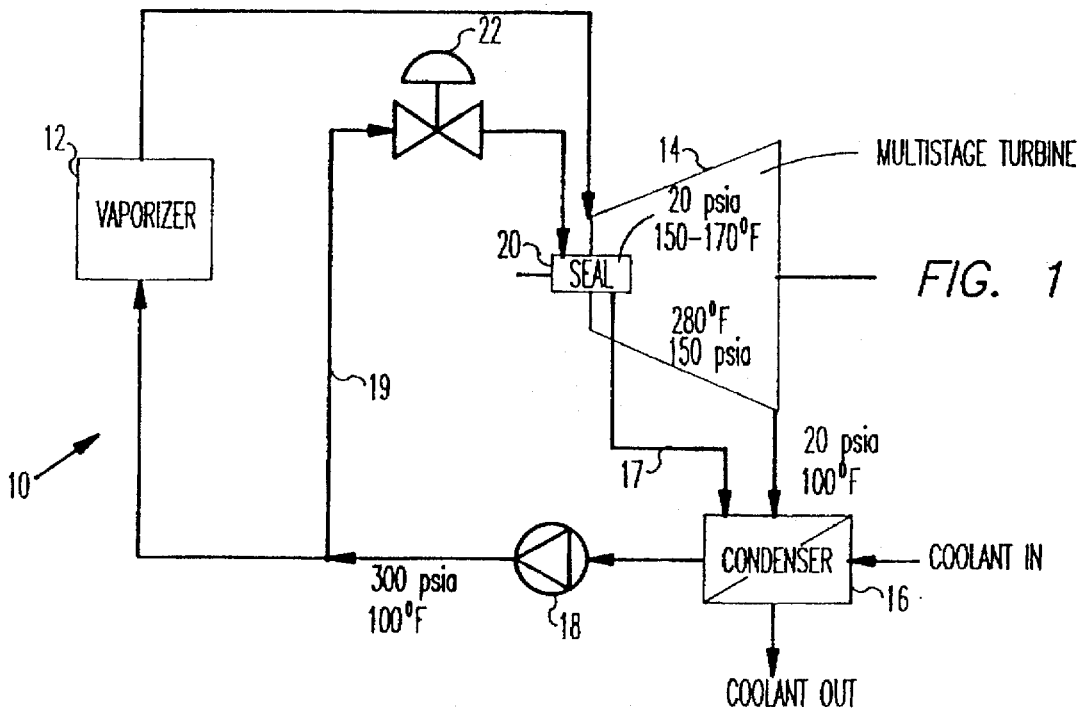
FIG. 1 is a block diagram of a power plant into which the present invention is incorporated.

Referring now to the drawings, reference numeral 10 of FIG. 1 designates a power plant into which the present invention is incorporated. Power plant 10 includes vaporizer 12 for vaporizing a working fluid, such as water, or an organic fluid (e.g., pentane, or isopentane), and producing vaporized working fluid that is supplied to turbine 14. Usually, turbine 14 will be a multistage turbine, but the principle of the invention is applicable to a single stage turbine as well.

Vaporized working fluid supplied to turbine 14 expands in the turbine and produces work which is converted into electricity by a generator (not shown). The cooled, expanded working fluid is exhausted into indirect condenser 16 wherein the vaporized working fluid is condensed by the extraction of heat in the coolant supplied to the condenser. The condensate, at a relatively low pressure and temperature, as compared to the conditions at the outlet of the vaporizer, is pressurized by cycle pump 18 and returned to the vaporizer, completing the working fluid cycle.

Seal 20, which is the seal between the atmosphere and the pressure chamber (not shown) containing the inlet stage of the turbine, is contained in a seal operating environment that is isolated from the pressure chamber by a labyrinth seal (not shown) and a mechanical seal (not shown) which is to be cooled. As shown, condensate is supplied to the seal operating environment by pump 18 through valve 22 in connection 19, and the seal operating environment is connected to condenser 16 by connection 17.

When power plant 10 is an organic fluid Rankine cycle power plant, operating with pentane, for example, as the working fluid, the conditions in the condenser typically will be about 100° F. at about 20 psia, and the conditions at the outlet of the cycle pump typically will be about 100° F. at about 300 psia. Connection 17, by which the seal operating environment is connected to the condenser, maintains this environment at the condenser pressure conditions.

The actual conditions in the seal operating environment can be controlled by valve 22 by regulating the flow of condensate to the environment. Typically, the leakage of working fluid vapor through the labyrinth seal into the seal operating environment will produce vaporized working fluid at about 150 psia and about 270° F. Under these conditions, the cooler liquid, which preferably will be distributed throughout the seal operating environment by converting the liquid supplied by the pump into droplets, will interact with the leakage vapor and cool the same by directly transferring heat to the liquid in the droplets and partially evaporating the liquid thus preventing the heating of the seal operating environment. This has the beneficial effect of reducing the temperature of the seal itself without directly cooling the seal with the condensate.

Figure 2:
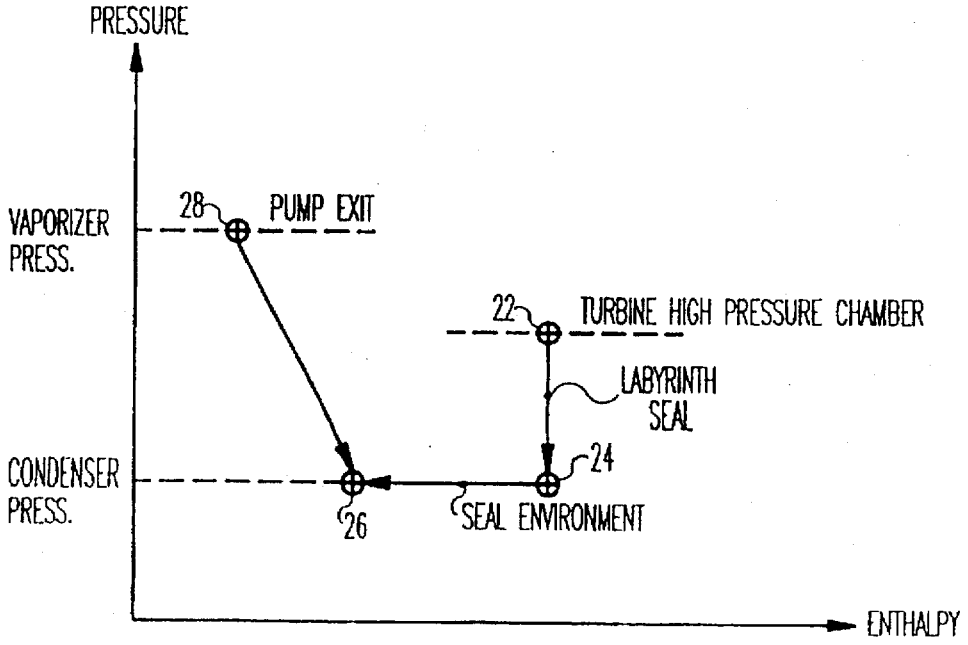
FIG. 2 is a pressure enthalpy diagram showing the sources of fluid that contribute to heating and cooling the seal.

The operation described above is illustrated by FIG. 2. As indicated, leakage of vapors from the pressure chamber of the turbine whose conditions are indicated by point 22 to the seal operating environment whose conditions are indicated by point 24 result in a pressure reduction inside the seal operating environment which is held at the conditions of the condenser indicated by point 26. Condensate furnished by the pump to the seal operating environment, at the conditions indicated by point 28, changes state from point 28 to point 26. Based on this schematic showing, the heat balance is as follows:

(1) $m_{liq}xh_{liq}+m_{vapor}xh_{vapor}=m_{mix}xh_{mix}$ where $m_{liq}$=cold liquid flow rate $h_{liq}$=enthalpy of cold liquid $m_{vapor}$=vapor leakage flow rate $h_{vapor}$=vapor enthalpy $m_{mix}=m_{liq}+m_{vapor}$ $h_{mix}$=enthalpy of mixture at condenser pressure and required mixture temperature.

Figure 3:
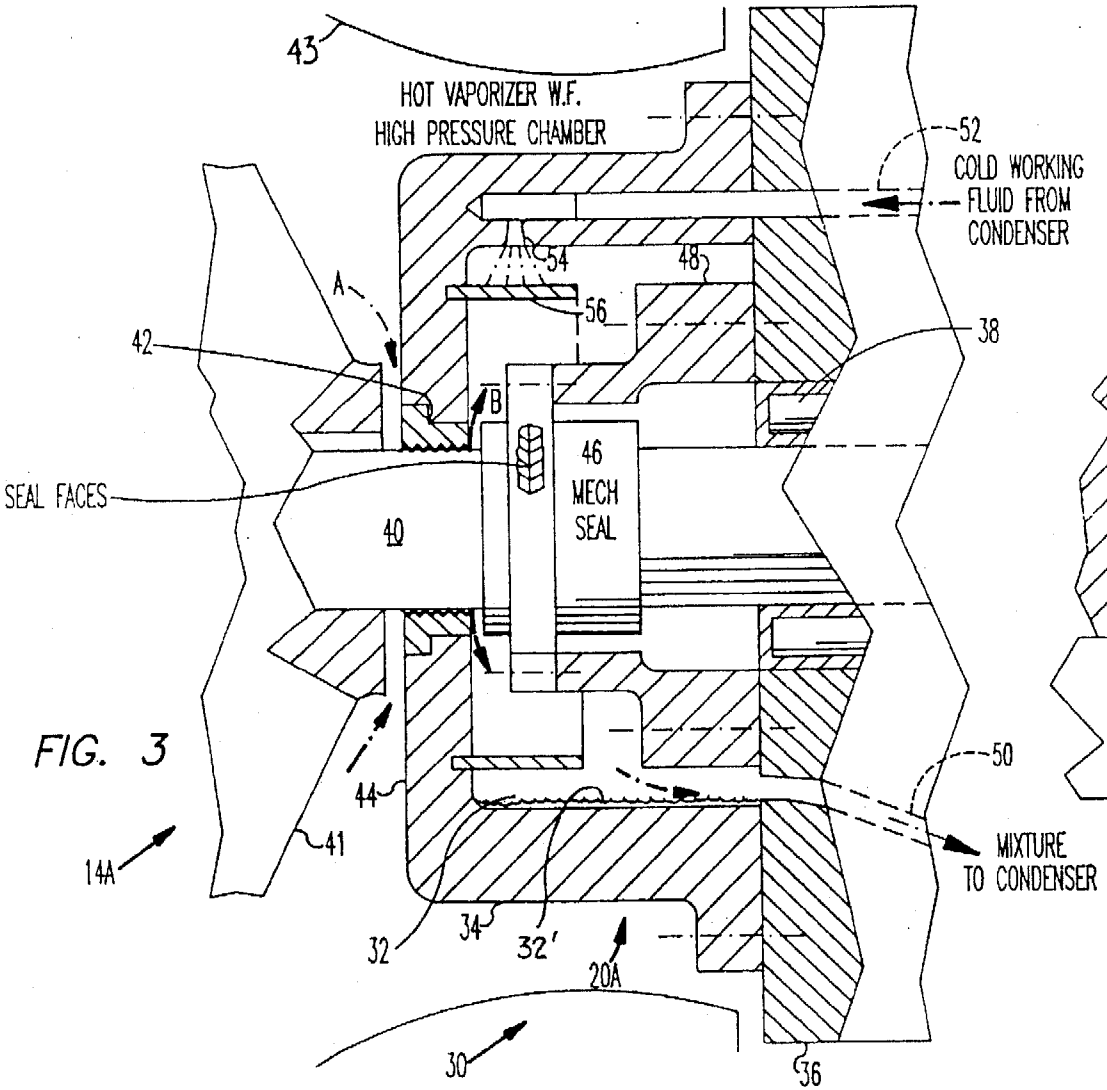
FIG. 3 is a side view, partially in section, showing one embodiment of the present invention.

Specific details of one embodiment of the invention is shown in FIG. 3 to which reference is now made where reference numeral 30 designates apparatus according to the present invention incorporated into turbine 14A. Apparatus 30 includes seal operating environment 20A in the form of chamber 32, defined by housing 34 rigidly attached to stationary mounting 36 containing bearing 38 on which shaft 40 of first stage turbine wheel 41 is mounted by a suitable key arrangement. Wheel 41 is contained by a housing that defines a high pressure housing or chamber 43 containing hot pressurized and vaporized working fluid.

Labyrinth seal 42 mounted in face 44 of housing 34 provides the initial resistance to leakage of the hot vaporized working fluid in chamber 43 into seal chamber 34. Such leakage is indicated by chain arrows A and B. Normally, this leakage would heat mechanical seal 46 having sealing faces carried by, and rotating with, shaft 40. This face is in contact with a stationary sealing face carried by hub 48 rigidly attached to housing 36. Normally, both stationary and rotating or dynamic seal faces are cooled by a barrier fluid, e.g., pressurized mineral oil pressurized to about 1.5 to 2 times the reduced chamber pressure (e.g., about 30 to 40 psia in the present embodiment).

Chamber 32 is connected by connection 50 to a source of low pressure, and particularly, to the condenser of the power plant with which turbine 14A is associated. This chamber is also connected via connection 52 to the output of the cycle pump as shown in FIG. 1. Pressurized condensate at the temperature substantially of the condenser is supplied via connection 52 to spray head nozzles 54 that open to the interior of chamber 32, and relatively cold liquid working fluid is sprayed onto cylindrical shield 56 further converting the liquid into fine droplets that form a mist inside chamber 32. This mist interacts with hot vapor leakage B thereby cooling this hot vapor by means of direct contact heat transfer of heat in the vapor to liquid contained in the droplets and partial evaporation of the liquid in the droplets and thus forming a mixture of working fluid that flows into sump 32' from which the mixture is vented and drained by connection 50 into the condenser. As a result, the temperature of mechanical seal 46 can be maintained at a desired temperature by regulating the amount of liquid supplied to connection 52. Shield 56 shields mechanical seal 46 from direct contact with cool liquid from the condenser and thus protects the seal against thermal shock.

Figure 4:
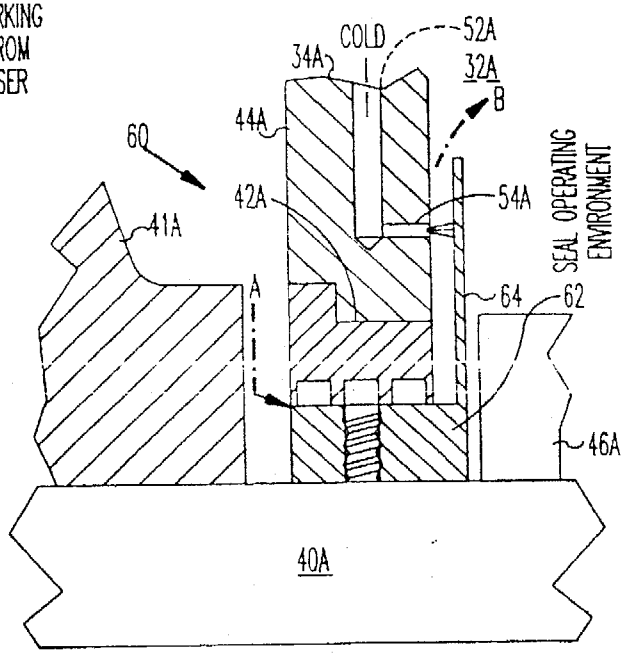
FIG. 4 is a block diagram of a modification of the embodiment shown in FIG. 3.

A second embodiment of the invention is shown in FIG. 4 and designated by reference numeral 60. This embodiment includes turbine wheel 41A rigidly attached to shaft 40A which passes though housing 34A, and mechanical seal 46A inside chamber 32A. Instead of labyrinth seal 42A engaging shaft 40A directly, as in the embodiment of FIG. 3, seal 42A engages hub 62 rigidly attached to the shaft. However, the labyrinth seal may engage the shaft if preferred. Hub 62 includes flange 64 that lies inside chamber 32A close to face 44A of housing 34A and thus rotates together with shaft 40A. Conduit 52A in face 44A carries liquid working fluid from the cycle pump to nozzle 54A opening to chamber 32A and facing flange 64.

Pressurized cold working fluid condensate from the condenser is sprayed into contact with flange 64 producing a spray of fine droplets which are carried by centrifugal force into chamber 32A by reason of the rotational speed of the flange. In addition, leakage of vaporized working fluid A through seal 42A encounters the spray of cold liquid as soon as the vaporized working fluid passes through seal 42A so that most of leakage B is cooled before entering chamber 34A. This embodiment provides rapid engagement of the hot vapor leaking into chamber 32A with cold working fluid, and the rotational movement of flange 64 ensures intimate mixing of the spray of cold liquid with leakage vapors.

In the preferred embodiment of the present invention described with reference to FIG. 5, power plant 10A comprises high pressure turbine 14A serially connected to low pressure turbine 14B. In this arrangement, vapor from vaporizer 12 is supplied to the inlet of turbine 14A and the exhaust therefrom is supplied to the inlet of turbine 14B. High pressure seal environments 70A and 70B, respectively associated with the turbines, are each supplied with cool condensate from condenser 16 by pump 18 via flow conditioning apparatus 19A and 19B, respectively. Apparatus 19A and 19B serves both to the properly regulate the flow of condensate to the seal environments, to isolate the flow of cool condensate to the seal environments of the two turbines, and to allow maintenance to the apparatus without interrupting the operation of the turbines.

Apparatus 19A includes manually operated, infinitely variable, flow control valve 22A, fixed orifice device 23A, filter 24A, and on/off, or shut-off valve 25A serially connected together, and temperature indicator 26A; and apparatus 19B includes corresponding components 22B, 23B, 24B, 25B, and 26B. The size of the fixed orifices of each of devices 23A and 23B, together with the setting of valves 22A and 22B respectively, determines the flow rate of cool condensate to the seal environments. Filters 24A and 24B serve to filter from the condensate supplied to the seal environments any contaminants whose presence would adversely affect the operation of the seal environments. Valves 25A and 25B are preferably manually operated ball-valves that can be selectively operated to disconnect the seal environments from pump 18 when filter replacement or other maintenance operations are necessary allowing the turbines to run for a short time without operation of the seal environments and until these maintenance operations are completed. Furthermore, maintenance operations, when the turbines or power plant is shut down or stopped, are also simplified by this aspect of the present invention. Finally, temperature indicators 26A and 26B provide an indication of the temperature of the fluid exhausted from seal environments 70A and 70B, respectively.

Valves 22A and 22B are manually operated, preferably in accordance with the temperature of the fluid in lines 17A and 17B connected to seal operating environments. That is to say, the amount of cooling condensate applied to a seal operating environment can be adjusted by an operator by changing the setting of valves 22A and 22B in response to the temperature indicated by indicators 26A and 26B. Optionally, the temperature indicators can be replaced by temperature sensors or transducers that produce control signals in accordance with the temperature of the cooling liquid leaving the seal environment. In such case, valves 22A and 22B could be replaced with valves which are responsive to such control signals for maintaining the proper flow rate of cooling liquid to the seal environments.

Figure 5:
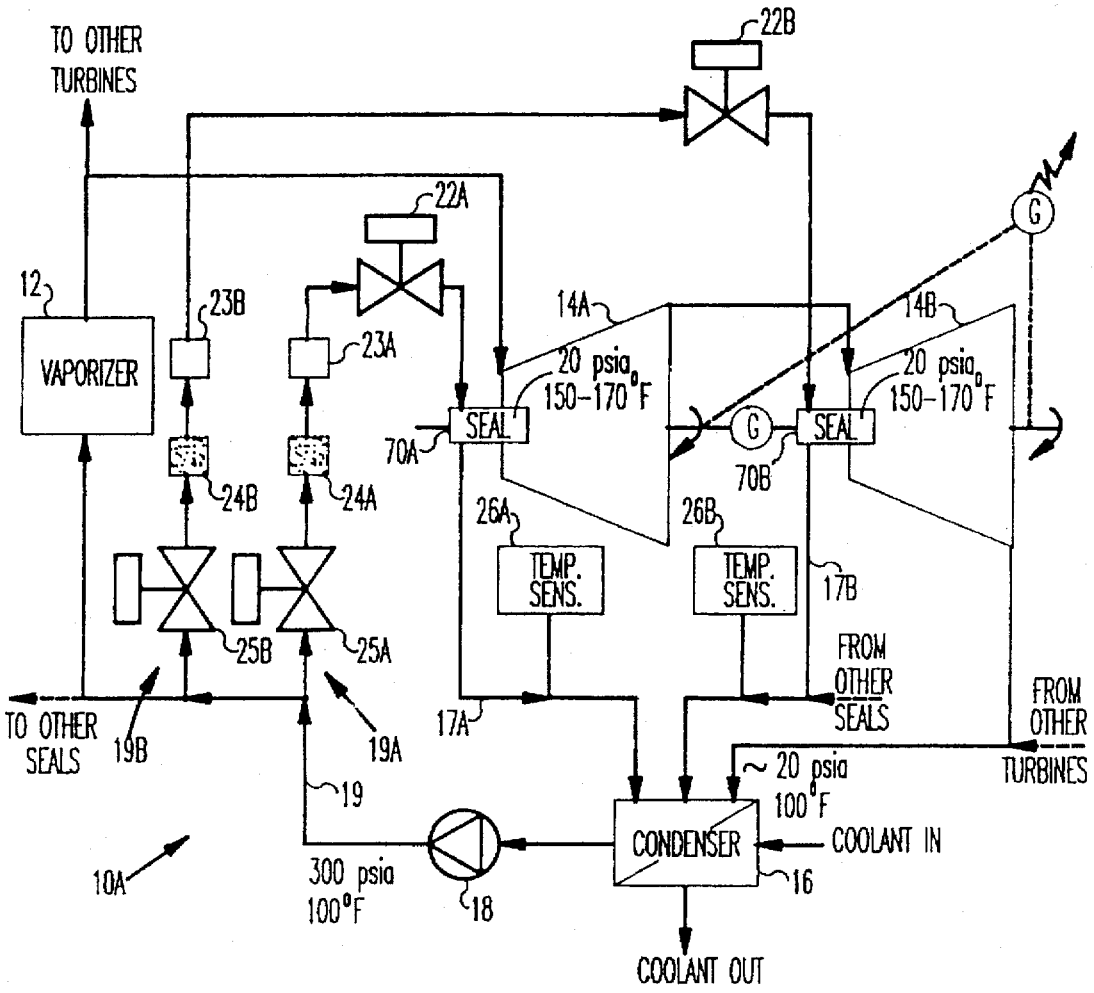
FIG. 5 is a further embodiment of the invention.

Modifications of the arrangement shown in FIG. 5 include connecting the turbines in parallel to the vaporizer instead of in series, or connecting several turbines in series or in parallel. This is suggested by the dashed lines extending from the output of the vaporizer, and extending to the inputs to the condenser. Furthermore, the invention is applicable to configurations in which separate vaporizers, feed pumps, and condensers are used. In such case, the flow rate to each seal environment can be controlled individually as a function of the temperature of the cooling liquid to take account of the specific operating conditions encountered by each seal environment. In addition, as shown in FIG. 5, turbines 14A and 14B preferably are directly connected to and drive a single, interposed, low speed (e.g., 1500 or 1800 RPM, depending upon the grid frequency) electric generator. Finally, if the prevailing conditions warrant, less than all of the turbines in a multiple turbine system may require a system for cooling the seals; and in such case, the seal cooling arrangement of the present invention would be used only as needed.

The present invention, while shown in connection with an organic vapor turbine is also applicable to cooling seals in a steam turbine, gas/vapor compressors, gas/vapor turbines, gas turbines, gas expanders and other types of rotary machines that employ seals for rotating shafts. In addition, the present invention may be used to cool seals in other machinery or engines including non-rotary machinery or engines, e.g., reciprocating machinery such as diesel engines and internal combustion engines, etc. As indicated, the present invention, which utilizes the working fluid itself for the coolant, does not require a separate recirculation system. However, if preferred, a separate auxiliary system can be used for the coolant which may use a fluid different from the working fluid.

While the description mentions the use of oil cooled seals, the present invention is useful for seals cooled by other fluids or even dry seals where no such cooling fluid is used. While the embodiments described above refer to a chamber as a form of the operating seal environment, any suitable enclosure may be used. The advantages and improved results furnished by the method and apparatus of the present invention are apparent from the foregoing description of the preferred embodiment of the invention. Various changes and modifications may be made without departing from the spirit and scope of the invention as described in the appended claims.

What is claimed:

1. A method for cooling the rotary seal of a turbine operating on vaporized working fluid that expands in the turbine producing expanded vaporized working fluid that is condensed in a condenser from which condensate is pumped into a vaporizer that produces said vaporized working fluid, said method comprising connecting the seal operating environment to the condenser, and pumping condensate into the seal operating environment.

2. Apparatus for cooling a mechanical seal heated by hot pressurized vapor comprising:

(a) a chamber for locating therein the seal and for containing vapor that leaks through said seal;

(b) a connection for connecting the chamber to a source of low pressure thereby reducing the pressure in the chamber to a level below the pressure of vapor that leaks into the chamber;

(c) a source of liquid for supplying liquid to the chamber at a pressure above the reduced pressure of the chamber; and (d) apparatus for distributing the liquid throughout the chamber in the form of droplets that contact and cool vapors in the chamber, thus cooling the seal.

3. Apparatus according to claim 2 including flow conditioning apparatus for regulating the supply of said liquid to said chamber, including a flow control valve operable to adjust the flow rate of said liquid.

4. Apparatus according to claim 3 wherein said chamber includes means for venting said chamber, and including a conduit for conveying vented fluid to said source, and a temperature sensor for sensing the temperature of the vented fluid, said flow control valve being adjusted in accordance with the sensed temperature.

5. Apparatus according to claim 4 wherein said flow conditioning apparatus includes a filter serially connected with said flow control valve for filtering said liquid before it is introduced into said chamber.

6. Apparatus according to claim 5 wherein said flow conditioning apparatus includes a shut-off valve upstream of said filter, and a flow control valve for selectively disconnecting said liquid from said chamber to enable replacement of the filter.

7. Apparatus according to claim 6 including a turbine wheel mounted on a shaft in a pressure chamber containing hot pressurized, vaporized working fluid, said shaft passing through a labyrinth seal mounted on the shaft between the turbine wheel and the seal.

8. Apparatus according to claim 7 wherein said apparatus for distributing the liquid throughout the chamber includes a disc in the chamber mounted on the shaft and rotating therewith, and means for causing said liquid to impinge on said disc and produce droplets.

9. Apparatus according to claim 7 wherein said hot pressurized working fluid expands in said turbine producing power and expanded working fluid, and including a condenser for condensing said expanded working fluid, and said source of low pressure said the condenser.

10. Apparatus according to claim 9 wherein said flow conditioning apparatus includes an orifice device defining a fixed orifice downstream of said shut-off valve for isolating the rate of flow of said liquid from variations in flow through said condenser.

11. Apparatus according to claim 2 including a turbine wheel mounted on a shaft in a pressure chamber containing hot pressurized, vaporized working fluid, said shaft passing through a labyrinth seal mounted on the shaft between the turbine wheel and the seal.

12. Apparatus according to claim 11 wherein the means for distributing the liquid throughout the chamber includes a disc in the chamber mounted on the shaft and rotating therewith, and means for causing said liquid to impinge on said disc and produce droplets.

13. Apparatus according to claim 12 wherein the means for connecting the chamber to a source of low pressure includes means for connecting the chamber to a condenser of an organic Rankine cycle power plant having a turbine operating on organic fluid.

14. Apparatus according to claim 13 wherein the means for supplying cool and pressurized liquid to the chamber at a pressure above the reduced pressure of the chamber includes means for supplying organic working fluid to the chamber after the condensed organic fluid exiting the condenser of the organic Rankine cycle power plant has been pressurized by the cycle power plant pump.

15. Apparatus according to claim 2 wherein said source of low pressure is the condenser of a power plant.

16. Apparatus according to claim 15 wherein the condenser comprises a condenser of a power plant having a steam turbine.

17. Apparatus according to claim 16 wherein the means for supplying cool and pressurized liquid to the chamber at a pressure above the reduced pressure of the chamber includes means for supplying condensate to the chamber after the condensate exiting the condenser of the steam turbine power plant has been pressurized by the cycle power plant pump.

18. Apparatus according to claim 16 wherein the means for supplying cool and pressurized liquid to the chamber at a pressure above the reduced pressure of the chamber includes means for supplying water to the chamber.

19. A method for cooling the seal associated with a turbine that receives vaporized working fluid from a vaporizer and within which the vaporized working fluid expands producing expanded working fluid, and where the expanded working fluid is condensed in a condenser to produce condensate that is returned to a vaporizer by a cycle pump, the method comprising connecting the chamber containing the seal to the condenser, and using the pump to furnish condensate supplied to the chamber.

20. Apparatus for use with a vaporizer for producing vaporized working fluid from liquid working fluid, and a condenser for producing liquid working fluid from expanded vaporized working fluid, and a pump for returning liquid working fluid from said condenser to said vaporizer, said apparatus comprising:

a) a first turbine having a shaft and being responsive to vaporized working fluid produced by said vaporizer for expanding the vaporized working fluid and producing work at the shaft of the first turbine, and expanded working fluid;

b) a second turbine having a shaft and being responsive to expanded working fluid produced by said first turbine for further expanding the expanded working fluid and producing work at the shaft of the second turbine, and further expanded working fluid;

c) an electric generator coupled to the shafts of the first and second turbines for generating electricity;

d) a seal operating environment associated with said one of the turbines including:

(1) a chamber in which a seal for the shaft of said one of the turbines is located and for containing vapor that leaks the thereinto;

(2) a connection for connecting the chamber to said condenser thereby reducing the pressure in the chamber to a level below the pressure of vapor that leaks into the chamber;

(3) said pump supplying liquid working fluid from the condenser to the chamber at a pressure above the reduced pressure of the chamber;

(4) apparatus for distributing the liquid throughout the chamber in the form of droplets that contact and cool vapors in the chamber, thus cooling the seal; and (e) flow conditioning apparatus for regulating the supply of liquid to said chamber of the seal operating environment, and including a flow control valve operable to adjust the flow rate of said liquid.

21. A method for cooling a seal heated by hot pressurized vapor comprising the steps of:

(a) providing a chamber for locating therein the seal and for containing vapor that leaks through said seal;

(b) reducing the pressure of the chamber by connecting it to a source of low pressure;

(c) supplying liquid to the chamber at a pressure above the reduced pressure of the chamber and at a temperature below the temperature of vapor leaking into the chamber; and (d) forming liquid in said chamber into droplets and distributing such droplets throughout the chamber for contacting vapor that leaks thereinto thereby cooling the vapor and thus cooling the seal.

22. A method according to claim 21 including adjusting the flow rate of said liquid.

23. A method according to claim 22 including the steps of:

(a) venting fluid from said chamber;

(b) sensing the temperature of the vented fluid; and (c) adjusting the flow rate in accordance with the sensed temperature.

24. A method according to claim 23 including adjusting the flow rate in response to the sensed temperature.

25. A method according to claim 22 including filtering said liquid before it is introduced into said chamber.

26. A method according to claim 25 including selectively disconnecting said liquid from said chamber to enable replacement of the filter.

27. A method according to claim 1 including controlling the rate at which condensate is pumped into said seal operating environment.

28. A method according to claim 27 including removing fluid from said seal operating environment, sensing the temperature of the removed fluid, and controlling the rate at which condensate is pumped into said seal operating environment in accordance with the sensed temperature.

29. A method according to claim 21 wherein the hot pressurized vapor is contained in a pressure chamber within which a turbine wheel is mounted on a shaft, and vapor leaks past a labyrinth mounted on the shaft between the turbine wheel and the seal.

30. A method according to claim 29 wherein the step of forming the liquid into droplets is carried out by spraying the liquid onto a disc mounted in the chamber, said disc being mounted on the shaft on which the turbine wheel is mounted.

31. A method according to claim 21 wherein reducing the pressure of the chamber is achieved by connecting the chamber to a condenser of a power plant.

32. A method according to claim 31 wherein the power plant includes a vaporizer for vaporizing a working fluid, a turbine for expanding the working fluid, a condenser for condensing expanded working fluid, and a cycle pump for returning condensate from the condenser to the vaporizer.

33. A method according to claim 32 wherein the liquid supplied to the chamber is derived from the output of the cycle pump.

34. A method according to claim 32 wherein the working fluid is water.

35. A method according to claim 32 wherein the working fluid is an organic fluid.

36. Apparatus for use with a vaporizer for producing vaporized working fluid from liquid working fluid, and a condenser for producing liquid working fluid from expanded vaporized working fluid, and a pump for returning liquid working fluid from said condenser to said vaporizer, said apparatus comprising:

a) a first turbine having a shaft and being responsive to vaporized working fluid produced by said vaporizer for expanding the vaporized working fluid and producing work at the shaft of the first turbine, and expanded working fluid;

b) a second turbine having a shaft and being responsive to expanded working fluid produced by said first turbine for further expanding the expanded working fluid and producing work at the shaft of the second turbine, and further expanded working fluid;

c) an electric generator interposed between the first and second turbines and directly connected to the shafts thereof for generating electricity;

d) a seal operating environment associated with each turbine, each seal operating environment including:

(1) a chamber in which a seal for the shaft of the turbine is located and for containing vapor that leaks thereinto;

(2) a connection for connecting the chamber to said condenser thereby reducing the pressure in the chamber to a level below the pressure of vapor that leaks into the chamber;

(3) said pump supplying liquid working fluid from the condenser to the chamber at a pressure above the reduced pressure of the chamber;

(4) apparatus for distributing the liquid throughout the chamber in the form of droplets that contact and cool vapors in the chamber, thus cooling the seal; and (e) flow conditioning apparatus associated with each turbine for regulating the supply of liquid to the chamber of the seal operating environment associated with the turbine, each flow conditioning apparatus including a flow control valve operable to adjust the flow rate of said liquid.

37. Apparatus according to claim 36 wherein each seal operating environment includes means for venting fluid in the chamber of said operating environment to said condenser, and a temperature sensor associated with each turbine for sensing the temperature of the fluid vented from the chamber of the seal operating environment associated with the turbine, the flow control valve associated with each turbine being adjusted in accordance with the sensed temperature of the fluid vented from the chamber of the seal operating environment associated with the turbine.

38. Apparatus according to claim 37 wherein each flow conditioning apparatus includes a filter serially connected with the flow control valve for filtering said liquid before it is introduced into said chamber, and a shut-off valve upstream of said filter and flow control valve for selectively disconnecting said liquid from said chamber to enable replacement of the filter.

39. An organic Rankine cycle power plant having a vaporizer for producing vaporized organic fluid, a turbine receiving said vaporized organic fluid, and having at least one wheel contained in a housing for producing power and expanding hot organic fluid vapor, a condenser for condensing expanded organic vapor, a cycle pump for supplying the condensed organic liquid from the outlet of the condenser to said vaporizer, said power plant comprising:

(a) a seal for sealing the turbine wheel housing;

(b) a chamber for locating therein the seal and for containing hot organic fluid vapors;

(c) means for reducing the pressure of the chamber by connecting it to the condenser of the power plant;

(d) means for supplying cool and pressurized liquid to the chamber from the outlet of the cycle pump at a pressure above the reduced pressure of the chamber;

(e) means for distributing the liquid throughout the chamber by forming droplets of the liquid for contacting the hot vapors and cooling them, thus cooling the seal.

40. A method for cooling a seal heated by hot pressurized vapor comprising the steps of:

(a) providing a chamber for locating therein the seal and for containing vapor that leaks through said seal;

(b) supplying liquid to the chamber at a temperature below the temperature of vapor leaking into the chamber; and (c) causing liquid in said chamber to form into droplets and distributing such droplets throughout the chamber for contacting vapor that leaks thereinto thereby cooling the vapor and thus cooling the seal.

41. A method for cooling a hot seal comprising the steps of:

(a) providing a chamber for locating therein the seal;

(b) reducing the pressure of the chamber by connecting it to a source of low pressure;

(c) supplying cool and pressurized liquid to the chamber at a pressure above the reduced pressure of the chamber;

(d) distributing the liquid throughout the chamber by forming droplets of the liquid for contacting the gas in the chamber and cooling it, thus cooling the seal.

* * * * *